US005322382A

United States Patent [19]

Hull et al.

[11] Patent Number: 5,322,382

[45] Date of Patent: Jun. 21, 1994

[54] COMBINATION LOTION APPLICATOR AND STAND

[76] Inventors: Harold L. Hull, 401 Canyon Way #43, Sparks, Nev. 89434; Mary A. Byrum; Samuel J. Lynch, both of P.O. Box 2545, Sparks, both of Nev. 89432

[21] Appl. No.: 51,518

[22] Filed: Apr. 26, 1993

[51] Int. Cl.[5] ..... A45D 34/00

[52] U.S. Cl. ..... 401/131; 401/140; 401/186; 401/202; 401/207

[58] Field of Search ..... 401/186, 131, 140, 202, 401/207

[56] References Cited

U.S. PATENT DOCUMENTS

| | | | |
|---|---|---|---|
| D. 297,467 | 8/1988 | McCann | D28/7 |
| D. 313,553 | 1/1991 | Lewis | D9/338 |
| 3,412,418 | 11/1968 | Griffen | 401/207 X |
| 4,078,865 | 3/1978 | Moser | 401/140 X |
| 4,124,316 | 11/1978 | O'Rourke | 401/186 X |
| 4,171,171 | 10/1979 | Jones | 401/202 X |
| 4,483,636 | 11/1984 | Meyer | 401/266 |
| 4,762,433 | 8/1988 | Bergeson et al. | 401/186 X |
| 4,869,612 | 9/1989 | Mooney | 401/130 |
| 4,872,778 | 10/1989 | Longo | 401/266 |
| 4,883,380 | 11/1989 | Ritterman | 401/208 |
| 4,889,441 | 12/1989 | Tice | 401/131 |
| 4,934,011 | 6/1990 | Haug | 15/145 |
| 5,087,138 | 2/1992 | Terbrusch et al. | 401/140 X |
| 5,125,757 | 6/1992 | Morrison | 401/21 |

FOREIGN PATENT DOCUMENTS

| | | | |
|---|---|---|---|
| 83845 | 5/1921 | Australia | 401/131 |

*Primary Examiner*—Steven A. Bratlie

[57] ABSTRACT

A combination dispenser-applicator and stand with the dispenser having a hollow interior and at one end means to fill the hollow interior with a topical solution such as lotion and the stand acting in one mode as a stand and cover for the sponge portion of the applicator head but also allowing the sponge cover to be removed from the stand to enable the user to transport the-applicator in a covered manner without taking the applicator stand.

12 Claims, 2 Drawing Sheets

COMBINATION LOTION APPLICATOR AND STAND

FIELD OF THE INVENTION

This invention relates to dispenser-applicators for dispensing and application of lotion, sunscreens, or other liquid topical preparations.

BACKGROUND OF THE INVENTION

Many attempts have been made in the past, to provide a liquid applicator which is used with lotions or the like. Some examples include U.S. Pat. No. 5,125,757 which provides a lotion dispenser applicator including an elongate handle member having on one end a ball applicator assembly, oppositely-faced sponge applicator assembly and a reservoir for storage. U.S. Pat. No. 4,483,636 provides an elongate tubular member having a cavity extending through its entire length for liquid input and includes an end cap. On its distal end, a spherical structure cooperates with a socket, a dispensing head, a flat application surface and a porous pad to deliver solution to the persons skin surface.

U.S. Pat. Nos. D297,467, D313,553 and 4,869,612 all of which teach an elongate handle having at their distal end an applicator means such as a porous pad.

U.S. Pat. No. 4,883,380 provides a lotion applicator being of a compact design but does not provide the objects and advantages as does the present invention.

Also, U.S. Pat. No. 4,869,612 provides a liquid applicator of a different structure however, this device has inherent problems which the present invention addresses.

It is therefore obvious that there is a need for an improved lotion applicator. The present prior art have inherent problems, such as continual dyinq out or stiffening of the sponge, lack of economy in the usage of lotion and may include undesirable contamination.

The present invention provides a handle member having a cavity extending through its entire length for input of solution and includes a cap for containment thereof, and being of a unique hand friendly and ergonomic design, which cooperates with a stand to hold and capture the applicator and sponge. Also included for convenience to the user, is a cup like cap removably affixed to the stand and/or sponge, whereby providing a dual purpose, that of which allows the user to choose either positioning the applicator within the cup like cap on the stand when not in use, or remove the applicator and cup like cap from the stand for easy portability.

SUMMARY OF THE INVENTION

It is therefore an object of the present invention to provide an improved lotion or topical solution applicator which eliminates many of the inherent problems associated with the prior art.

Another object is to provide a lotion applicator which cooperates with a stand for a functional yet decorative effect.

Yet another object is to provide a handle member which is hand friendly and of an ergonomic design.

Also another object is to provide an applicator with means which on demand, wets the sponge yet does not saturate, so as to reduce drying out or stiffening of the sponge.

Yet another object is to provide the handle member with an elongate cavity extending through its entire length for insertion of topical solution or the like.

Still another object is to provide the handle member with an end cap so as to contain the topical solution there within.

Another object is to provide the handle member with means to removably attach a sponge.

Also another object is to provide means for the cup like cap to removably attach to the handle member and/or the stand.

Still another object of the present invention is to provide an applicator which would allow the user to dispense and apply a topical solution to various difficult-to-reach parts of the human anatomy without the assistance of others. Yet another object is to provide the stand in a configuration to hold the applicator on the stand in a position which allows the sponge applicator end to be in a position substantially lower than the supply end to keep the applicator end moist with the topical solution.

Another object is to provide replaceable sponges.

Yet another object is to provide the sponge with means to attach to the handle member, such as an adhesive backing.

Still another object is to provide a deformable membrane with a first and second position, the first position allowing fluid to flow thru the membrane while the second position restricts the flow of fluid.

Also another object is to provide a one-way valve mechanism to allow air to enter the tube handle when the flexible handle is released from a squeezed position.

Other objects and advantages will become apparent when taken into consideration with the following drawings and specifications.

DETAILED DESCRIPTION OF THE DRAWINGS

Figure 5:
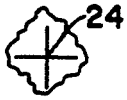
FIG. 5 is a slitted cross, drawn to a larger scale of one of the cross slits in the membrane of FIG. 3 and shown in a closed position.
Figure 6:
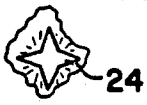
FIG. 6 is a slitted cross, drawn to a larger scale of one of the cross slits in the membrane of FIG. 3 and shown in an open position.

Referring now in detail to the drawings wherein like characters refer to like elements throughout the various drawings, 10 is an overview showing our new topical solution substantially hollow applicator 12 resting on stand 14, with the substantially round end section 16 of stand 14 providing a base and support for the topical solution applicator head 18 of the applicator 12, with 20 being a cover for head 18, with 22 being a membrane made of a resilient material such as rubber and having slits 24 as shown in detail in FIGS. 5 and 6, FIG. 5 showing a closed position with FIG. 6 showing an open position.

Figure 4:
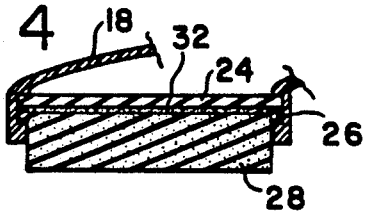
FIG. 4 is a section taken at 4—4 of FIG. 1.

Membrane 22 is held in place within the head 18 by snap ring 26 as shown assembled in sectional view of FIG. 4, while 28 is an applicator sponge with an adhesive 32 covered by peel-off backing 30 with the applicator sponge 28 being made of a material such as sponge rubber or other material of engineering choice.

Figure 12:
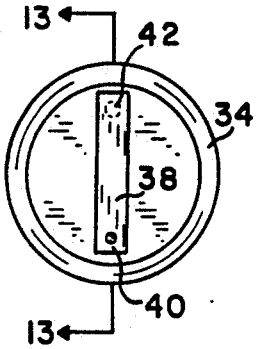
FIG. 12 is an internal view of the end cap of FIG. 11, drawn to a larger scale showing a one-way valve means.
Figure 13:
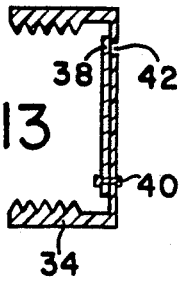
FIG. 13 is a section taken at 13—13 of FIG. 12.

On the opposite end of applicator 12 is a ca p 34 which cooperates with threads 36 of applicator 12 to enable the addition of a topical solution such as lotion (not shown) with cap 34 having a one-way valve means such as the reed valve 38 shown in FIG. 12 and by section in FIG. 13 and which is affixed to the cap 34 by means such as rivet 40 With 42 being an air entrance opening which is closed by reed valve 38 when in its normally closed position, the reed valve 38 is made of spring steel or other suitable material having a memory.

Figure 1:
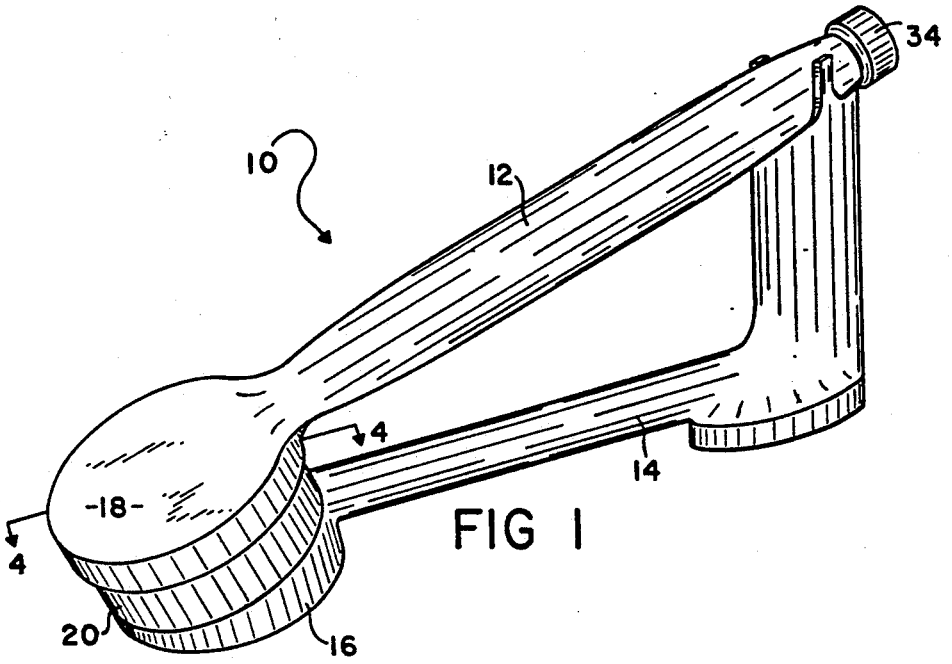
FIG. 1 is a perspective view of the applicator positioned on the stand.
Figure 2:
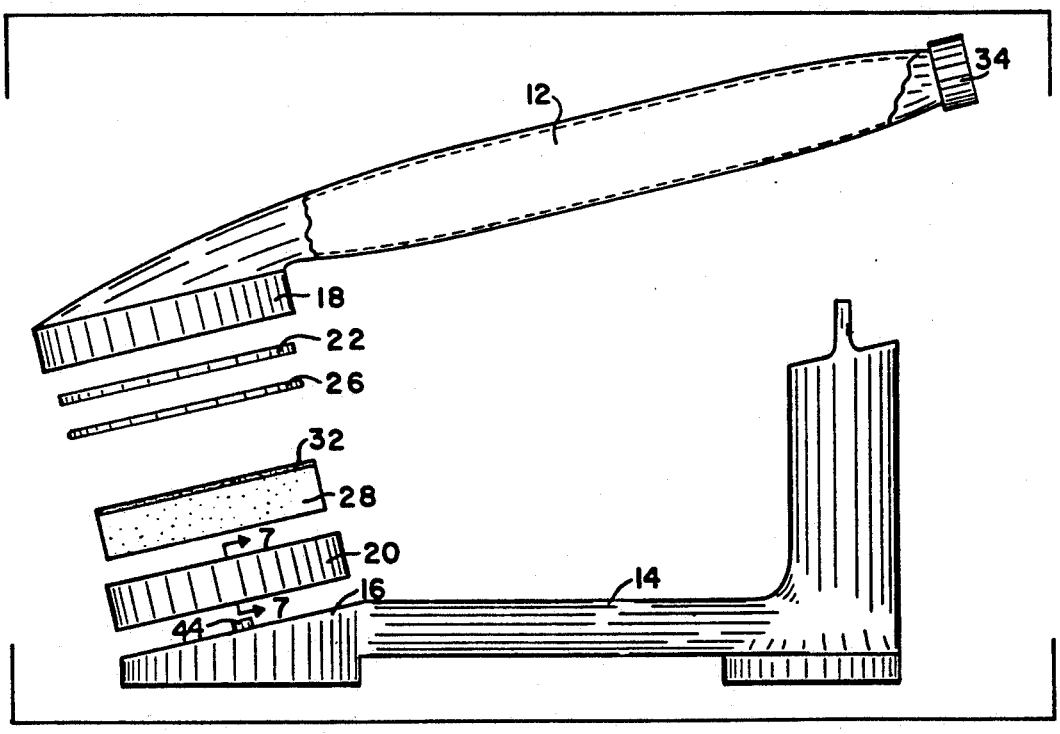
FIG. 2 is an exploded plan view of the applicator and stand.
Figure 3:
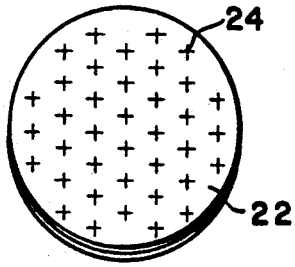
FIG. 3 is a perspective view of a perforated membrane associated with the release apparatus of the applicator.
Figure 7:
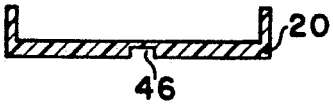
FIG. 7 is a section taken at 7—7 of FIG. 2.
Figure 8:
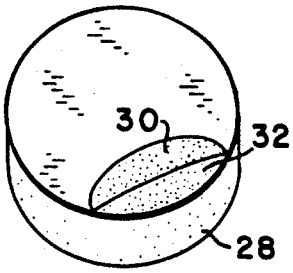
FIG. 8 is a perspective view of a sponge having a peel-off adhesive backing.
Figure 9:
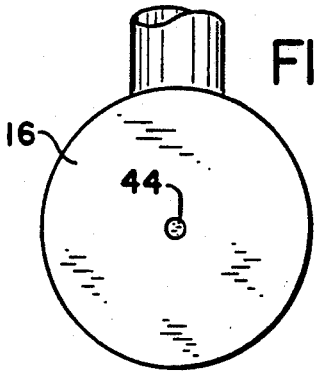
FIG. 9 is a partial top view of the end of the stand which holds the applicator cover.
Figure 10:
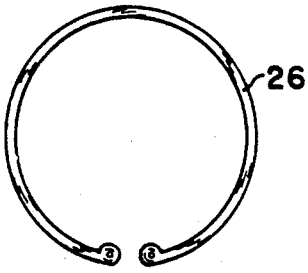
FIG. 10 is a top view of an internal snap ring.
Figure 11:
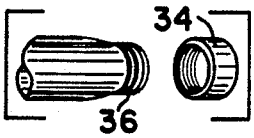
FIG. 11 is a partial view of one end of the applicator thru which the topical solution is added.

In FIG. 2 a detent 44 is shown which cooperates with indent 46 in the cover 20 as depicted in FIGS. 7 and 9, respectively, and provides a friction fit which allows the cover 20 to be retained on the stand base end 16 when desired and retained on the applicator 12 for mobility purposes if the base 14 is, by choice, left behind.

It will now be seen that we have provided a combination stand and topical solution applicator which may be made of a material such as plastic by injection molding which has replaceable sponges and a positive means to eject the solution into the applicator sponge by squeezing the handle and when the handle is allowed to relax, the one-way valve in the end cap allows air to enter the cavity within the applicator thus reducing the possibility of sucking the solution away from the applicator sponge.

It will also be noted that when the applicator is at rest on its stand that the sponge applicator end is below the supply end thus keeping the topical solution by gravity in the lower sponge applicator end to keep the membrane and sponge from drying out and maintained in a moist condition.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described our invention, what we claim as new and desire to secure by letters patent is:

1. A combination dispenser-applicator and stand for dispensing and applying a topical preparation to a surface comprising in combination; a substantially hollow elongate handle having a first and second end, said handle having a center portion, said center portion being adapted to be held by a user, said center portion being made of a flexible material having a head, said dispenser head communicating with said center portion of said hollow handle, a deformable membrane, said head having retaining means to hold said membrane within said head, said membrane having at least one slit, said slit having a first and second position, said first position being closed, said second position being open, a sponge, said sponge having means to be retained against the outer surface of said membrane, a removable sponge cover, said second end of said handle having removable means to allow said hollow handle to be filled with said topical preparation, a stand, said stand supporting said first end of said dispenser-applicator in a position below said second end of said dispenser-applicator when said dispenser applicator is at rest on said stand, said stand cooperating with a said dispenser-applicator to hold said dispenser-applicator in a secure yet easily removable position, whereby, when said dispenser-applicator contains said topical preparation and said flexible center portion of said handle is squeezed by a user, said topical preparation is forced out of said slit in said membrane into said sponge.

2. The dispenser-applicator and stand of claim 11 in which said flexible material having a memory is plastic.

3. The dispenser-applicator and stand of claim 11 in which said flexible membrane is made of rubber.

4. The dispenser-applicator and stand of claim 11 in which said means to retain said sponge against said membrane is by an adhesive.

5. The dispenser-applicator and stand of claim 1 in which said means to retain said membrane within said head is by a snap ring.

6. The dispenser-applicator and stand of claim 1 in including means to retain said sponge cover over said sponge.

7. The dispenser-applicator and stand of claim 6 in which said means to retain said sponge cover over said sponge is by a friction fit.

8. The dispenser-applicator and stand of claim 11 including means to removably secure said sponge cover to said stand.

9. The dispenser-applicator and stand of claim 8 in which said means to removably secure said sponge cover to said stand is by a friction fit between an indent and detent between said sponge cover and said stand.

10. The dispenser-applicator and stand of claim 1 in which said second end of said handle has removable means to allow said hollow handle to be filled with said topical preparation is by a screw-on cap.

11. The dispenser-applicator and stand of claim 10 in which said screw-on cap has a one-way valve.

12. The dispenser-applicator and stand of claim 11 in which said one-way valve is a reed valve.

* * * * *